US011570878B2

(12) United States Patent
Gonzales et al.

(10) Patent No.: US 11,570,878 B2
(45) Date of Patent: Jan. 31, 2023

(54) DEVICE FOR PRODUCING RADIO FREQUENCY MODULATED X-RAY RADIATION

(71) Applicant: MICRO-X LIMITED, Tonsley (AU)

(72) Inventors: Brian Gonzales, Tonsley (AU); Robert C. Sheehy, Tonsley (AU)

(73) Assignee: MICRO-X LIMITED, Tonsley (AU)

( * ) Notice: Subject to any disclaimer, the term of this patent is extended or adjusted under 35 U.S.C. 154(b) by 0 days.

(21) Appl. No.: 16/615,375

(22) PCT Filed: May 25, 2018

(86) PCT No.: PCT/AU2018/000078
§ 371 (c)(1),
(2) Date: Nov. 20, 2019

(87) PCT Pub. No.: WO2018/213867
PCT Pub. Date: Nov. 29, 2018

(65) Prior Publication Data

US 2020/0163196 A1 May 21, 2020

(30) Foreign Application Priority Data

May 25, 2017 (AU) ..... 2017901986

(51) Int. Cl.
*H01J 35/14* (2006.01)
*H05G 1/08* (2006.01)
(Continued)

(52) U.S. Cl.
CPC ..... *H05G 1/08* (2013.01); *H01J 35/065* (2013.01); *H01J 35/14* (2013.01); *H05G 1/02* (2013.01)

(58) Field of Classification Search
CPC ..... H01J 35/101; H01J 35/1017; H01J 2235/062; H01J 35/065; H01J 35/14;
(Continued)

(56) References Cited

U.S. PATENT DOCUMENTS 6,277,318 B1 8/2001 Bower et al.
6,553,096 B1 4/2003 Zhou et al.
(Continued)

FOREIGN PATENT DOCUMENTS

DE 36 05 735 A1 10/1986

*Primary Examiner* — Irakli Kiknadze
(74) *Attorney, Agent, or Firm* — Seed Intellectual Property Law Group LLP

(57) ABSTRACT

A device and method for creating controlled radio frequency (RF) modulated X-ray radiation is described. The device includes an anode housed within a vacuum enclosure which acts to accelerate and convert an electron beam into X-ray radiation. A RF enclosure is housed within the vacuum enclosure and houses a field emission device, such as a carbon nanotube field emission device or similar cold cathode field emission device. The field emission device is biased to emit the electron beam from a field emission cathode via an extraction electrode in the RF enclosure towards the anode. Additionally an RF impedance matching and coupling circuit is connected electrically to the field emission device. The field emission device is thus directly driven with a RF signal to produce an RF modulated electron current to produce an RF modulated X-ray radiation.

30 Claims, 9 Drawing Sheets

(51) Int. Cl.
*H01J 35/06* (2006.01)
*H05G 1/02* (2006.01)

(58) Field of Classification Search
CPC ..... H01J 2237/31701; H01J 37/32; H01J 65/042; H01J 2235/068; H01J 2235/20; H01J 35/16; G01N 23/06; G01N 23/02; H02J 50/005; H02J 50/10; H02J 50/70; H02J 7/0042; H02J 7/025; G01V 5/0016; G01V 5/0041; H05G 1/02; H05G 1/08; H05G 1/085; H05G 1/10; H05G 1/70; H05G 2/00; H05G 2/008; A61N 5/1049; A61N 5/107; A61N 2005/1051; A61N 2005/1054; A61N 2005/1059; A61N 2005/1061; A61N 2005/1074; A61N 5/1031; A61N 5/1038; A61N 5/1039; A61N 5/1048; A61N 5/1067; A61N 5/1071; A61N 5/1081; A61N 2005/1097; A61N 5/10; A61N 1/205; A61N 1/36; A61N 1/3785; A61N 1/3787; A61B 6/03; A61B 6/032; A61B 6/4447; G06T 11/008; G06T 2207/10081; G06T 2207/20081; G06T 7/0012; H04N 13/161; H04N 13/246; A61G 13/12; A61G 13/121; A61G 2200/325; G01T 1/22; G01T 1/29
USPC ..... 378/119, 138, 139
See application file for complete search history.

(56) References Cited

U.S. PATENT DOCUMENTS 6,630,772 B1 10/2003 Bower et al.
6,787,122 B2 9/2004 Zhou
6,850,595 B2 2/2005 Zhou et al.
6,876,724 B2 4/2005 Zhou et al.
6,965,199 B2 11/2005 Stoner et al.
6,969,690 B2 11/2005 Zhou et al.
6,980,627 B2 12/2005 Qiu et al.
7,085,351 B2 8/2006 Lu et al.
7,245,692 B2 7/2007 Lu et al.
7,252,749 B2 8/2007 Zhou et al.
7,294,248 B2 11/2007 Gao
7,333,587 B2 2/2008 De Man et al.
7,359,484 B2 4/2008 Qiu et al.
7,455,757 B2 11/2008 Oh et al.
7,486,772 B2 2/2009 Lu et al.
7,505,562 B2 3/2009 Dinca et al.
7,570,409 B1 * 8/2009 Wang ..... G02F 1/31 257/17
7,618,300 B2 11/2009 Liu et al.
7,751,528 B2 7/2010 Zhou et al.
7,850,874 B2 12/2010 Lu et al.
8,002,958 B2 8/2011 Zhou et al.
8,111,808 B1 * 2/2012 Wood ..... G01V 5/0025 378/87
8,155,262 B2 4/2012 Zhou et al.
8,189,893 B2 5/2012 Zhang et al.
8,447,013 B2 5/2013 Sprenger et al.
8,842,806 B2 9/2014 Packard et al.
8,971,484 B2 3/2015 Beckmann et al.
9,070,554 B2 6/2015 Toyoda et al.
9,552,955 B2 1/2017 Beckmann et al.
9,659,390 B2 5/2017 Huo et al.
2003/0052612 A1 3/2003 Tanabe
2005/0184257 A1 * 8/2005 Elsheref ..... H01J 37/304 250/492.22
2006/0217025 A1 9/2006 Hsiao et al.
2006/0290259 A1 12/2006 Song et al.
2009/0041198 A1 2/2009 Price et al.
2011/0188635 A1 8/2011 Cho et al.
2014/0369459 A1 12/2014 Foos et al.
2015/0043712 A1 2/2015 Wang et al.
2015/0139386 A1 * 5/2015 Star-Lack ..... G01V 5/0041 378/57
2015/0265223 A1 9/2015 Simon et al.
2015/0320371 A1 11/2015 Heath et al.
2016/0106382 A1 4/2016 Lu et al.
2016/0181053 A1 6/2016 Wang et al.
2016/0256128 A1 9/2016 Wang et al.
2016/0270745 A1 9/2016 Heath et al.
2016/0323985 A1 * 11/2016 Kaertner ..... H05G 2/008
2017/0219498 A1 8/2017 Chtcheprov et al.
2017/0248532 A1 8/2017 Kadambi et al.
2018/0135178 A1 5/2018 Miura et al.
2018/0204729 A1 7/2018 Sonoda et al.

* cited by examiner

DEVICE FOR PRODUCING RADIO FREQUENCY MODULATED X-RAY RADIATION

CROSS-REFERENCE TO RELATED APPLICATION

The present application claims priority from Australian Provisional Patent Application No. 2017901986 titled "Device for Producing Radio Frequency Modulated X-Ray Radiation" and filed on 25 May 2017, the content of which is hereby incorporated by reference in its entirety.

BACKGROUND

Technical Field

Embodiments of the present invention relate generally to devices for producing X-ray radiation, and in particular to devices producing radio frequency modulated X-ray radiation using a vacuum tube with a field emission cathode source. Embodiments of the invention are suitable for use in devices using carbon nanotubes as a field emission cathode source, and it will be convenient to describe embodiments of the invention in relation to that exemplary, but non-limiting, application.

Description of the Related Art

Conventional X-ray radiation sources use thermionic emission from a heated cathode, either from the filament directly or a filament heated cathode electrode. These devices release electron flux that is a function of the cathode source temperature and the applied electric field appearing adjacent to the cathode from the anode and other electrodes in the vacuum tube such as the focus and grid electrodes. The limitation of these sources is that they have a relatively low bandwidth frequency response as a result of baseline cathode emission mechanism.

Modulation of the cathode-grid voltage produces a corresponding modulation of the electron beam current, but the amplitude swing without distortion is limited for the minimum current by the minimum electric field to cause electrons to leave the cathode and for the maximum cathode current by the temperature of the cathode. Operating the filament or cathode at a higher temperature to achieve a higher maximum electron flux results in a drastic reduction in filament lifetime. To increase the level of amplitude swing and the maximum modulation frequency, without sacrificing filament life, ideally the cathode baseline emission needs to follow the demand. This is not possible at high frequency with a thermionic source due to the thermal time lag of the filament mass.

In the field of radio frequency (RF) power amplifiers using vacuum tubes, there are a number of techniques used to increase the maximum usable amplification frequency of a specific design. For the UHF band, travelling wave tubes rely on modulating the electron beam once it has already formed and is in flight from the beam hole in the anode to the catcher electrode using a helical coupling-decoupling system. The bunching of the electrons and the interaction with the helix magnetic field produces voltage gain and RF power gain at the output. A significant amount of the power from the original electron source is wasted at the catcher electrode as heat.

In the case of VHF power amplifiers using vacuum tubes, an important element in tube design is the reduction of the cathode-grid capacitance and the cathode-anode capacitance. These tube amplifiers rely on external electronic circuitry to transform the modulated electron beam current into RF voltage and the swing of the voltage is limited mostly by the external sources and the transconductance curve of the vacuum tube. The RF voltage is then transformed by an impedance matching circuit for use with the intended load (e.g. Antenna or RF welding head).

In conventional thermionic or "hot" X-ray radiation sources, a metal filament cathode is heated up to produce electrons which are subsequently accelerated toward the anode to produce X-rays. An alternative to thermionic sources is field emission sources or "cold" sources. In field emission tubes, electrons are extracted from the tip of the object through a process called quantum tunneling. These electrons are then accelerated toward the anode for X-ray production. Field emission electron sources provide three main advantages over conventional thermionic electron sources, namely, they operate at room temperature, they can be electronically controlled, and they have an instantaneous response. The main concerns with field emission sources are tube lifetime and maximum power.

More recently, carbon nanotubes (CNTs) have been developed for use as field emitters in these X-ray sources. Due to their large aspect ratios and thermal and conductive stability, CNTs make ideal field emitters. Recent applications of CNT based multi-beam X-ray tubes to tomographic imaging systems have demonstrated significant improvement in image quality and increased flexibility in system design.

CNT multi-beam tubes generate a spatially distributed array of individually controllable X-ray focal spots within a single vacuum tube. By sequentially scanning each focal spot, a tomographic scan of an imaged object is acquired with no movement of the source. Generating a tomographic scan without moving the X-ray source removes motion induced blurring, resulting in increased resolution in the reconstructed images. The spatial distribution of X-ray focal spots within the multi-beam tube determines the geometry of the tomographic scan, as compared to the physical rotation of an X-ray source.

X-ray sources are not traditionally required to be RF devices and have a typical turn on characteristic that sees the radiation intensity rise to the peak value in the order of 0.1 ms to 1 ms (millisecond). The radiation emissions in most X-ray devices is of a pulse nature and may be short duration in the order of a few milliseconds, or quite long duration up to a few seconds if the radiation dose is required to be high. Most present applications of X-ray radiation are served adequately by this range of operation.

Recently however, high bandwidth X-ray sources capable of producing RF modulated X-ray radiation have been developed to enable three-dimensional X-ray backscatter imaging. In these devices an X-ray signal is modulated with two RF signals and transmitted into the imaged object; the backscatter signal is collected and the harmonic pattern of the RF signals is compared with the known signals to add depth information into a conventional X-ray backscatter signal. These devices modulate the electron beam in-flight using a Klystron or by modulating a linear particle accelerator device used to create X-rays.

X-ray sources modulated with microwave frequency (high frequency RF in the gigahertz range) have been proposed for radio therapy treatment. An array of X-ray sources is arranged around a target to irradiate the target. The sources are microwave frequency modulated with a microwave frequency matching the resonant frequency of the target material to increase the energy delivered to the target material. The proposed X-ray source includes an electron gun cathode and klystron to modulate the (in-flight) electron flux delivered to an energized target producing microwave modulated X-ray radiation.

RF modulated X-ray radiation, up to the high gigahertz range, has been proposed to create a three dimensional X-ray microscopy imaging system. In this device the X-ray radiation is modulated using a linear accelerator method. The proposed imaging system image X-ray transmission rather than backscatter, but uses a similar dual RF signal modulation proposed to generate depth information in the imaged objects.

However, a number of issues need to be addressed in order to produce a device capable of creating controlled radio frequency modulated X-ray radiation that can be used in practical applications. Many practical constraints exist with proposed designs, including undesirable limitations to the bandwidth and distortion of the modulated signal as well as the power, size and accuracy of existing designs. It would be desirable to provide a device for producing RF modulated X-ray radiation which addresses one or more of these constraints, or at least provides a useful alternative to existing systems.

SUMMARY

According to a first aspect, there is provided a device for creating controlled radio frequency (RF) modulated X-ray radiation, the device including: a vacuum enclosure; an anode housed within the vacuum enclosure, the anode acting to accelerate and convert an electron beam into X-ray radiation; an RF enclosure housed within the vacuum enclosure; a field emission device housed within the RF enclosure, the field emission device is biased to emit the electron beam from a field emission cathode via an extraction electrode in the RF enclosure towards the anode; and an RF impedance matching and coupling circuit connected electrically to the field emission device.

According to a second aspect, there is provided a method for creating radio frequency (RF) modulated X-ray radiation using a field emission cathode, the method comprising:

a) placing a field emission device within a RF enclosure housed in a vacuum enclosure comprising a target anode;

b) providing an RF signal directly to a biased field emission device to generate an RF modulated electron current beam;

c) orientating or directing the RF modulated electron current beam towards the target anode to produce RF modulated X-ray radiation from the target anode.

In one form, the field emission device comprises a cathode, and the RF impedance matching and coupling circuit is connected directly to the cathode, and the extraction electrode is configured to allow the RF modulated electron current beam to pass through the RF enclosure. In another form the field emission device comprises a cathode and an extraction electrode, and the RF impedance matching and coupling circuit is connected directly to the extraction electrode configured to allow the RF modulated electron current beam to pass through the RF enclosure.

In one form the field emission device comprises a cathode and an extraction electrode and the bias is applied to the cathode. In another form, the field emission device comprises a cathode and an extraction electrode and the bias is applied to the extraction electrode.

In one form, the extraction electrode is a grid extraction electrode. In another form the extraction electrode is an aperture extraction electrode.

In one form, the RF signal is impedance matched to the field emission device. In a further form, the impedance matching is integrated into the field emission device such that the field emission device has a 50 ohm input impedance. In a further form, the impedance matching is performed external to the RF enclosure.

In one form, the device further includes focusing electrodes for controlling the focus of the electron beam.

In one form, the field emission cathode is formed from multiple carbon nanotubes on a metal, semiconductor or insulator substrate.

In one form, the RF impedance matching and coupling circuit may be integrated with the field emission cathode on a ceramic or silicon substrate. In another form, the RF impedance matching and coupling circuit is formed from discrete components on a printed circuit board that mounts to the high voltage cathode feed-through on the outside of the vacuum enclosure.

In one form, the vacuum enclosure is a metal-ceramic vacuum chamber or a glass tube.

In one form, the vacuum enclosure includes an X-ray window to provide additional directivity to the X-ray radiation.

In one form, the device further includes an internal collimator housed within the vacuum enclosure to provide additional directivity of the X-ray radiation.

In one or more embodiments, the RF impedance matching and coupling circuit is further connected electrically to an external RF current source, and to a low frequency high-voltage bias circuit.

In one form, wherein the X-ray tube polarity is a positive high potential anode and a ground referenced RF enclosure. In another form, the X-ray tube polarity is a negative high potential referenced RF enclosure and a grounded anode, or a negative high potential referenced RF enclosure and a positive high potential anode.

Embodiments of the device and method may be configured for directly driving a field emission device with an RF signal to produce an RF modulated electron current. This can then travel to the anode to produce RF modulated X-ray radiation. Embodiments described herein enable construction of a compact device for generating continuously varying X-ray intensity at frequencies of 25 kHz or more, and in particular at the MHz and GHz frequencies.

BRIEF DESCRIPTION OF DRAWINGS

Embodiments of the invention will now be described in further detail by reference to the accompanying drawings. It is to be understood that the particularity of the drawings does not supersede the generality of the preceding description.

DETAILED DESCRIPTION

Figure 1:
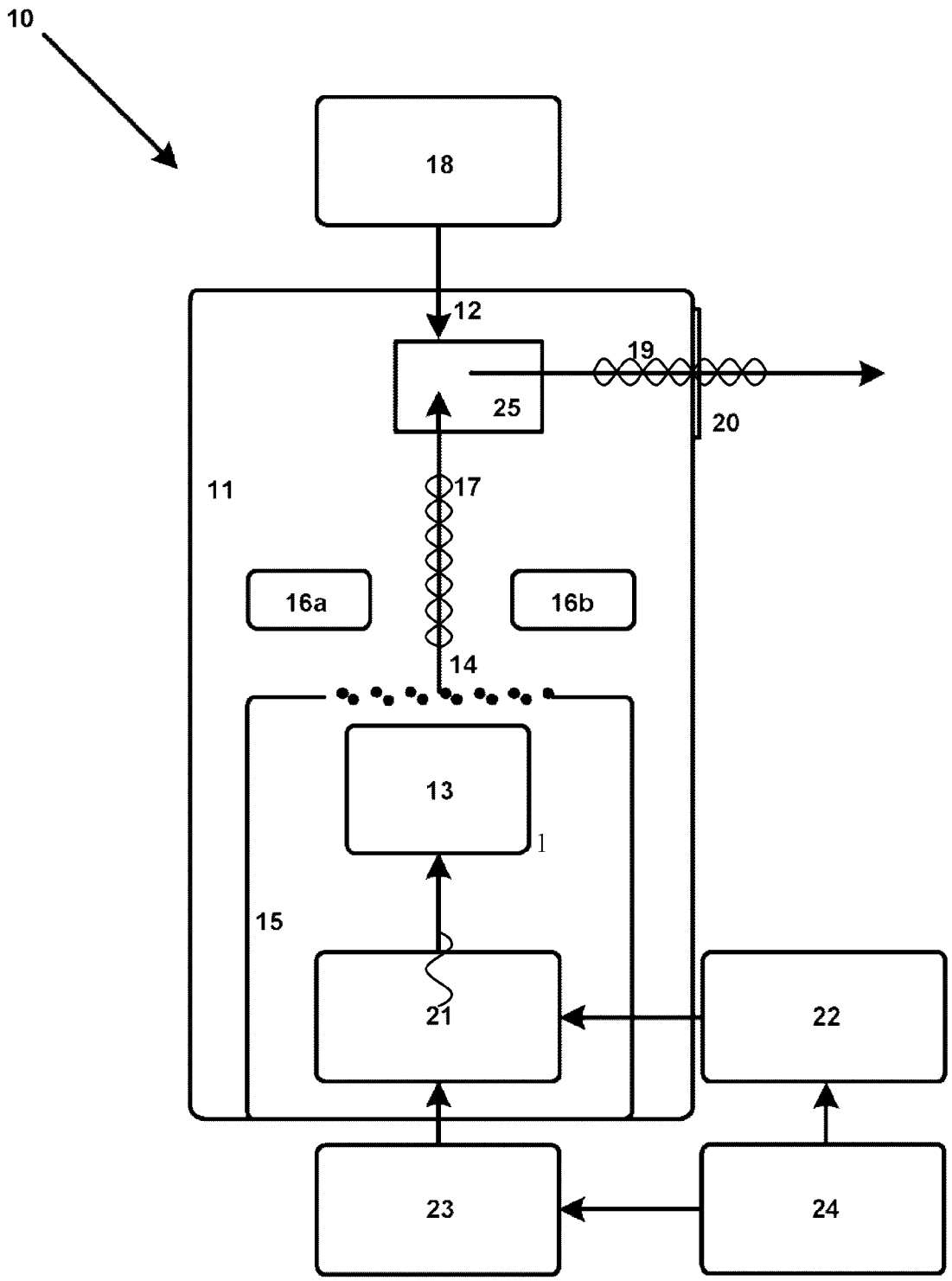
FIG. 1 is a schematic diagram of a first embodiment of a device for creating controlled RF modulated X-ray radiation.

Referring now to FIG. 1, there is shown an embodiment of a device (or apparatus) 10 for creating controlled RF modulated X-ray radiation including a vacuum vessel or enclosure 11 enclosing an anode electrode 12, such as an insulated high voltage heavy metal anode, a field emission device 1 biased to emit the electron beam from a field emission cathode 13 via an extraction electrode 14. An RF impedance matching and coupling circuit 21 is connected electrically to the field emission device 1. In this embodiment the extraction electrode is shown as a grid electrode 14 that provides a localized excitation field to cause electron emissions from the field emission cathode electrode. However in other embodiments the extraction electrode 14 may be other forms of extraction electrodes such as an aperture extraction electrode. An aperture extraction electrode has reduced losses compared to a grid electrode, but it can be more difficult to maintain a uniform field across the aperture to extract the electrons. In one or more embodiments, the vacuum vessel 11 may be a metal-ceramic vacuum chamber or a glass tube immersed in a metal oil bath enclosure.

In this embodiment the field emission device including the field emission cathode, the extraction electrode, and the RF impedance matching and coupling circuit 21 are contained within an RF enclosure 15 (within the vacuum enclosure). This ensures that only a localized cathode-grid field (or more generally a field emission cathode—extraction electrode field) affects the density of the electron emissions. The RF enclosure 15 decouples and shields the field emission cathode and extraction electrode from the anode and focus fields and capacitances.

To provide additional focusing power, where needed, focusing electrodes 16*a* and 16*b* are placed between the grid electrode 14 and the anode electrode 12.

The electron beam 17 generated due to an applied accelerating anode source voltage 18, is focused on to the target surface of the heavy metal anode 12 and directly converts a portion of the incident electron energy into X-ray radiation 19 where is it narrowed by a collimator 25.

The X-ray emission from the anode surface is hemispherical and the properties of the walls of the vacuum vessel 11 or its surrounds are chosen to prevent X-ray radiation from propagating outside the vessel 11. An X-ray window 20 is used on the vacuum vessel or the metal oil bath enclosure to allow X-ray radiation to emit in only that direction, thus providing directivity for the X-ray radiation and propagation outside the vacuum vessel.

The RF coupling and impedance matching circuit 21 applies the required bias voltage and current to establish the cathode-grid field for electron emissions, and adds a radio frequency modulation voltage so that the electron beam current is amplitude modulated by the radio frequency signal without distortion. The radio frequency signal is provided from an external controlled source 22 and the bias power is provided from a controlled low frequency current source 23.

The RF coupling and matching network is designed so that the high voltage bias voltage is not applied to the RF source and the RF input impedance of the X-ray tube is matched to the RF source impedance for maximum power transfer and low phase distortion. Both the bias source and the RF source are controlled by an external controller 24 so that the X-ray output from the X-ray tube follows the amplitude, phase and duration of the desired reference signal. That is, the field emission cathode 13 is directly driven with an RF signal to produce an RF modulated electron current 17 in which the electron flux at a point varies from zero to a maximum at a frequency corresponding to the input RF frequency (represented by vertical envelope pattern in FIG. 1). The target anode directly converts incoming electrons to X-ray radiation, with the number of X-ray photons emitted directly proportional to the number of incident electrons. Thus as the electron beam is modulated at the RF frequency, X-ray radiation 19 generated by the anode 12 is also modulated at the RF frequency. That is the amplitude (or intensity) of the X-ray radiation at a point varies from zero to a maximum at a frequency corresponding to the input RF frequency (represented by horizontal envelope pattern in FIG. 1).

Figure 2:
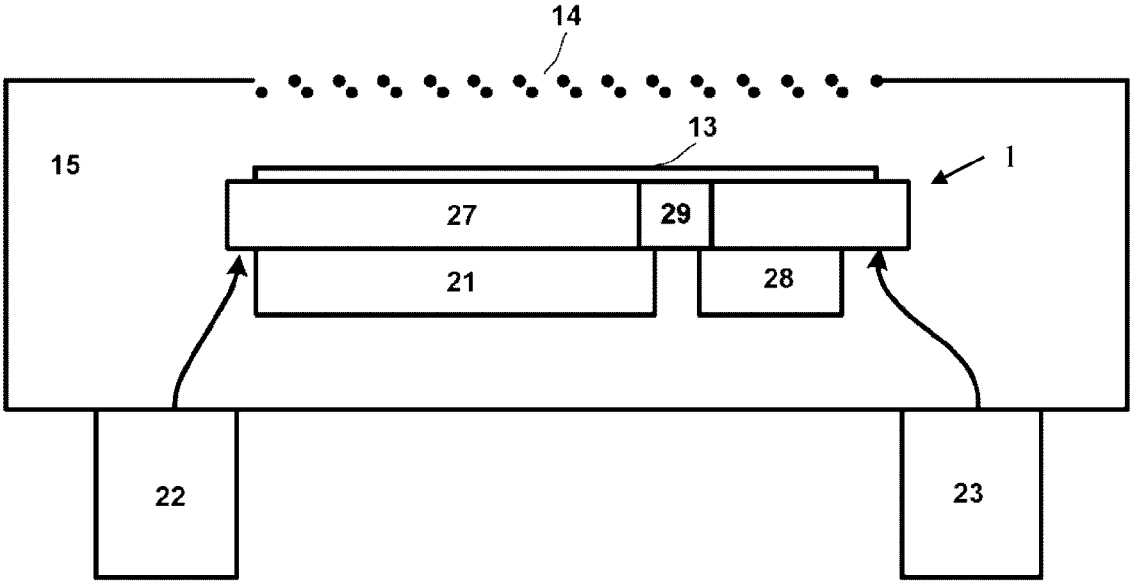
FIG. 2 is a schematic diagram showing an RF impedance matching and coupling circuit integrated with a CNT emitter on a ceramic/silicon substrate for use in one embodiment of the device shown in FIG. 1.

In this embodiment, the RF coupling and impedance matching circuit 21 is enclosed within an extension of the vacuum vessel 11 and separate vacuum feedthrough connections provided for the bias source 23 and RF signal source 22. This enables the RF impedance matching and coupling circuit 21 and high voltage bias electrode 28 to be integrated with the field emission cathode 13 via one or more vertical interconnects 29 on a ceramic or silicon substrate 27, as shown in FIG. 2. In this way the RF impedance matching and coupling circuit 21 can be integrated into the field emission device 1.

Figure 3:
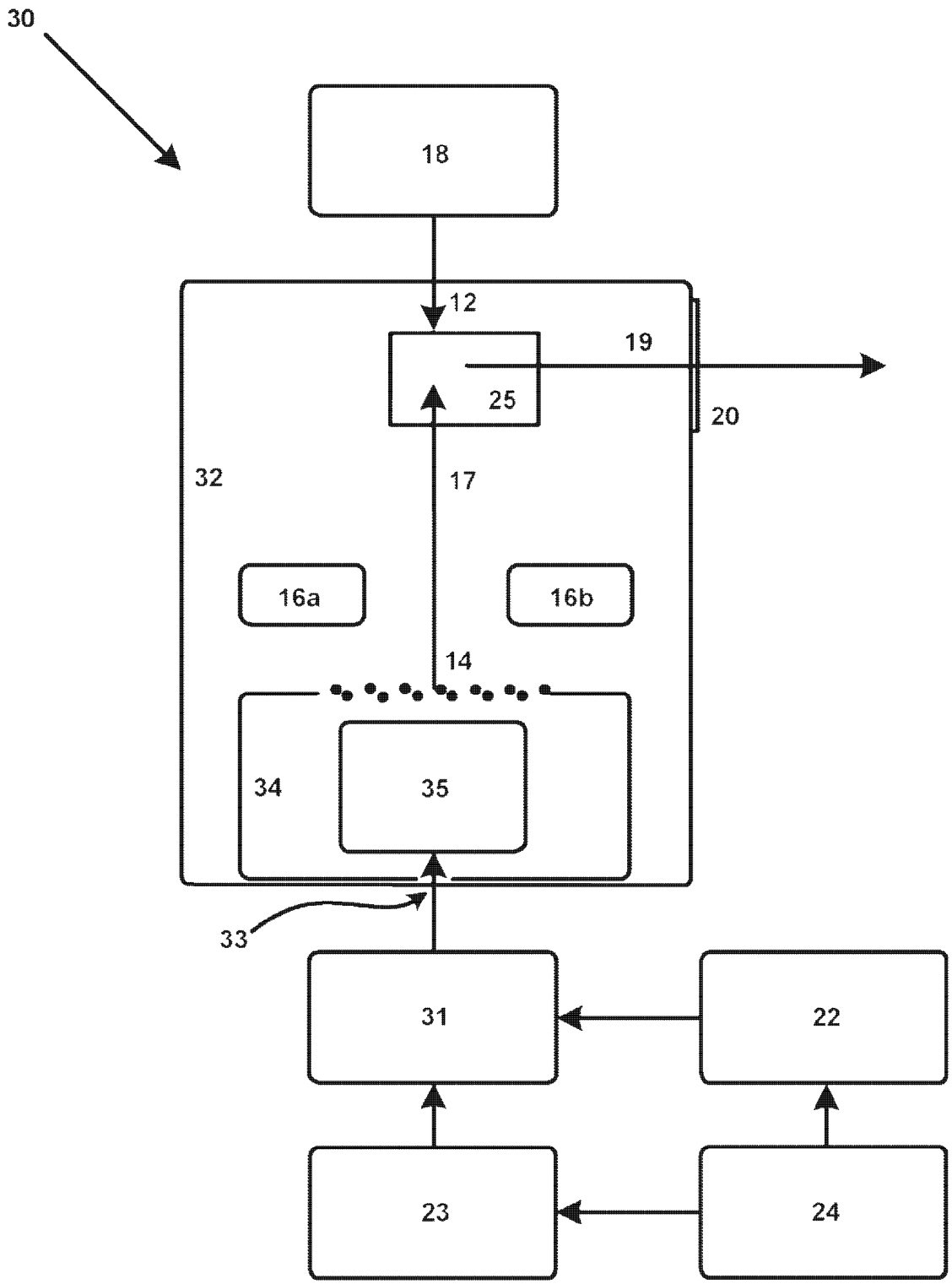
FIG. 3 is a schematic diagram of a second embodiment of a device for creating controlled RF modulated X-ray radiation.

However, in the embodiment shown in FIG. 3, the device 30 for creating controlled RF modulated X-ray radiation includes an RF coupling and impedance matching circuit 31 that is external to the vacuum vessel 32 and uses an RF vacuum feedthrough connection 33 to connect to the vacuum vessel 32. In this embodiment, the RF enclosure 34 encloses the field emission cathode electrode 35 but not the RF coupling and impedance matching circuit 31. The remaining elements shown in FIG. 3 are identical to FIG. 1 and so share the same references. In this embodiment, the RF impedance matching and coupling circuit 31 is formed from discrete components or RF microstrip or stripline techniques on a printed circuit board 38 that mounts to the vacuum vessel with standoffs 36*a* and 36*b*, as shown in FIG. 4.

Figure 4:
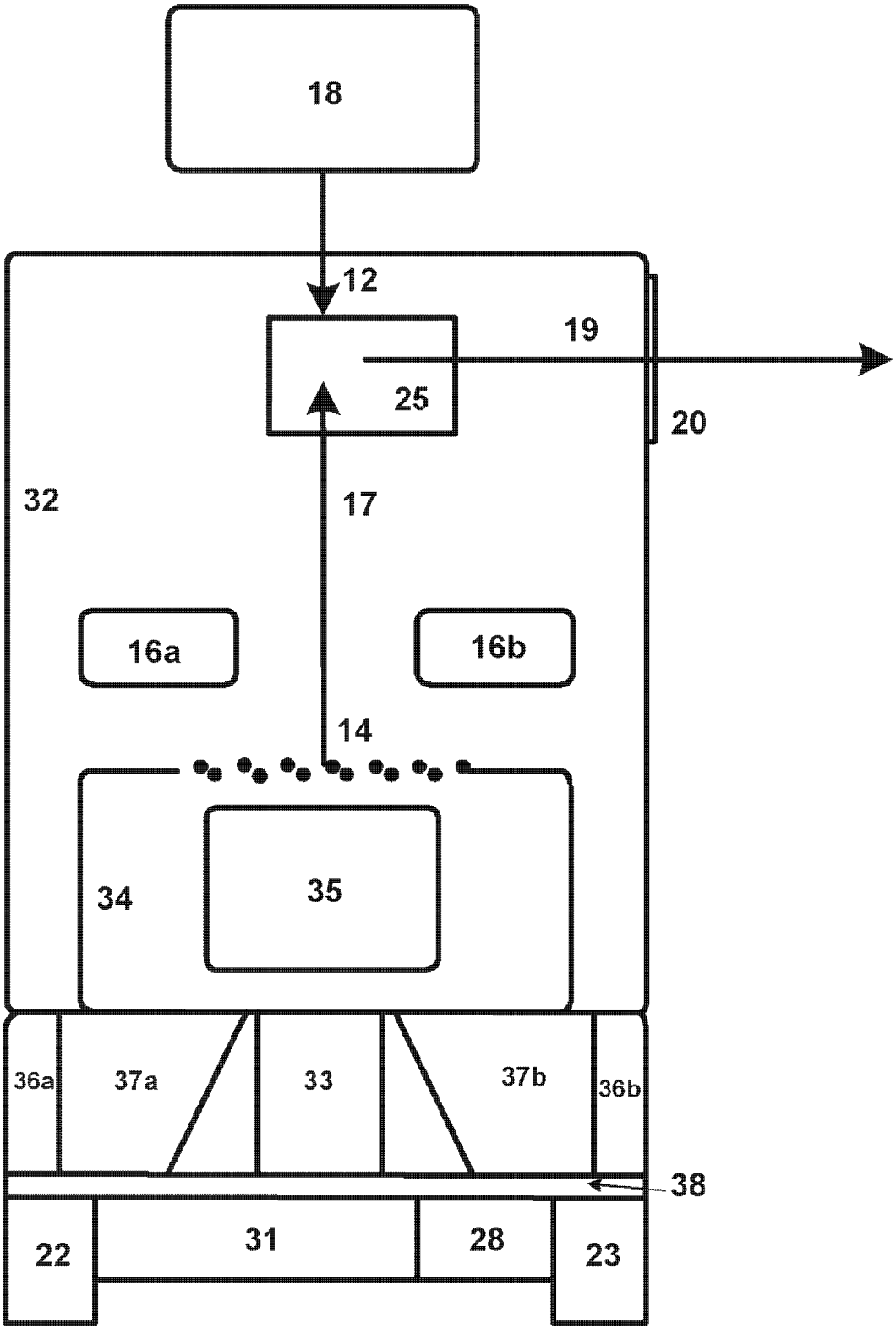
FIG. 4 is a schematic diagram showing an RF impedance matching and coupling circuit made of discrete components on a printed circuit board mounted to a high voltage cathode feed-through on the outside of a vacuum enclosure for use in one embodiment of the device shown in FIG. 3.

In the embodiment shown in FIG. 4, the RF vacuum feedthrough connection 33 connecting the impedance matching and coupling circuit to the field emission cathode electrode is shielded with RF shielding 37*a* and 37*b* to reduce spurious signal interference. The remaining elements shown in FIG. 4 are identical to FIG. 2 and FIG. 3 and so share the same references.

Various configurations of field emission devices, extraction electrodes, and anode polarity and voltages can be used to generate field emission. In one embodiment the field emission device 13 comprises a cathode, and the RF impedance matching and coupling circuit 21 is connected directly to the cathode (such as shown in FIG. 3) and the extraction electrode is configured to allow the RF modulated electron current beam to pass through the RF enclosure 15. In another embodiment the field emission device 1 comprises a cathode 13 and an extraction electrode 14, and the RF impedance matching and coupling circuit 21 is connected directly to the extraction electrode 14 that is configured to allow the RF modulated electron current beam to pass through the RF enclosure 15.

Typically the RF signal used to drive the field emission device 1 is impedance matched to the field emission device to improve the power transfer and efficiency of the system. In some embodiments the impedance matching is integrated into the field emission device such that the field emission device has a 50 ohm input impedance. In some embodiments the impedance matching is performed external to the RF enclosure. However strictly an unmatched RF signal could be used drive the field emission device provided the input RF signal is of sufficiently high power such that some power is transferred to the field emission device.

In embodiments where portability, compactness or low complexity are the primary concerns then the X-ray tube polarity will be configured with a positive high potential anode 12 and a ground referenced RF enclosure 15. However the system could also be configured such that the X-ray tube polarity is a negative high potential referenced RF enclosure and a grounded anode, or a negative high potential referenced RF enclosure and a positive high potential anode. The latter two systems could be used for specialized radiation treatments. However these latter two designs uses a negative high potential RF enclosure, which adds significant complexity and physical size to the system, as the radio frequency source 22 and frequency current source 23 must be located within the high potential RF enclosure.

Figure 5:
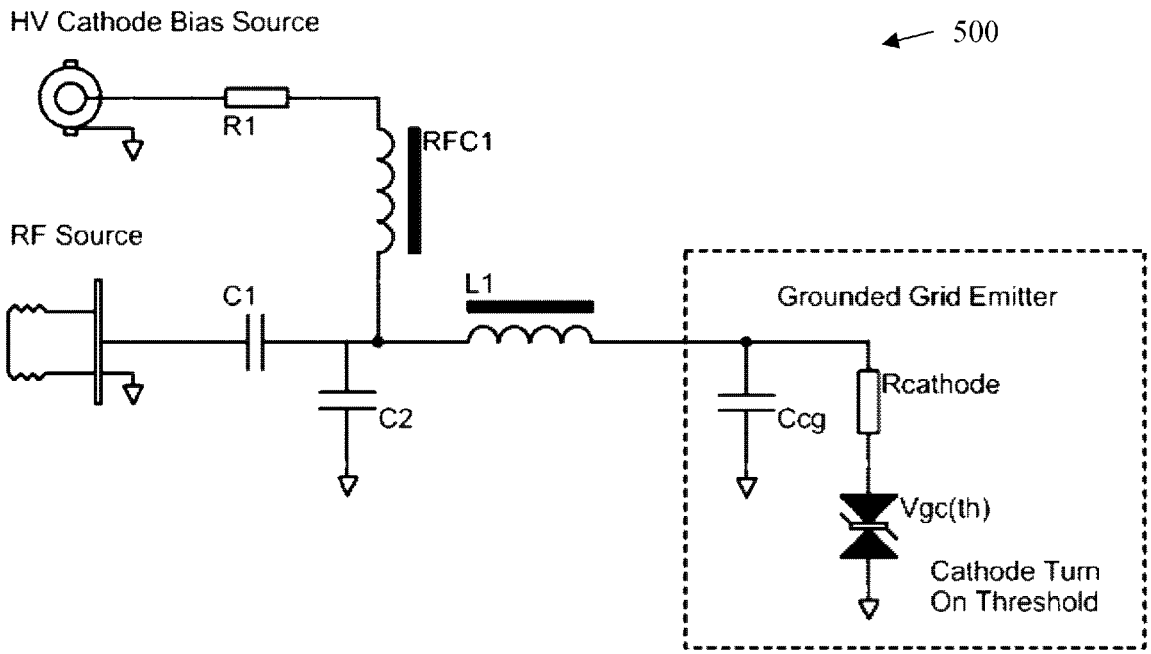
FIG. 5 is a circuit diagram of an RF impedance matching and coupling circuit equivalent for a lumped element model of the cathode emitter forming part of the devices depicted in FIGS. 1 and 3.

In FIG. 5, one implementation of the RF coupling and matching network 21 (and 31) is depicted in a schematic diagram 500 using lumped elements for a grounded grid electrode version of the RF X-ray tube. The cathode emitter appears in this figure as a combination of a shunt vacuum capacitance Ccg, and a blocking voltage Vgc(th) with an effective series resistance Rcathode.

In order to maximize RF power supplied to the emitter, the load impedance of the cathode emitter is transformed to match the RF source impedance by the matching elements L1 and C2. The RF source is AC coupled to the matching network via a high voltage RF capacitor C1. The low frequency or DC bias current and voltage is applied to the network via a current limiting resistor R1 and an RF blocking inductor RFC1 so that the RF signal is prevented from flowing to the bias source.

It will be appreciated that there are many methods to implement the elements of the RF coupling and matching network, with microstrip or stripline circuit board techniques, such as quarter wave transformers, being preferred for frequencies above 300 MHz.

The modulation frequency of the X-rays depends upon the input RF frequency (in most cases a 1:1 mapping). In most embodiments the RF input signal will be in the range of Megahertz (MHz) to tens of Gigahertz (GHz) or more as this simplifies generation (or transfer) of the RF signal. Whilst frequencies as low as 25 kilohertz (kHz) can be generated, systems operating in the 25 kHz to 1 MHz (and in particular sub 100 kHz) requires careful design of the system to avoid stray capacitances and impedances adversely affecting delivery of a RF driver signal to the field emission device (i.e. the lower frequency limit is effectively set by the complexity of the RF circuit).

Figure 6:
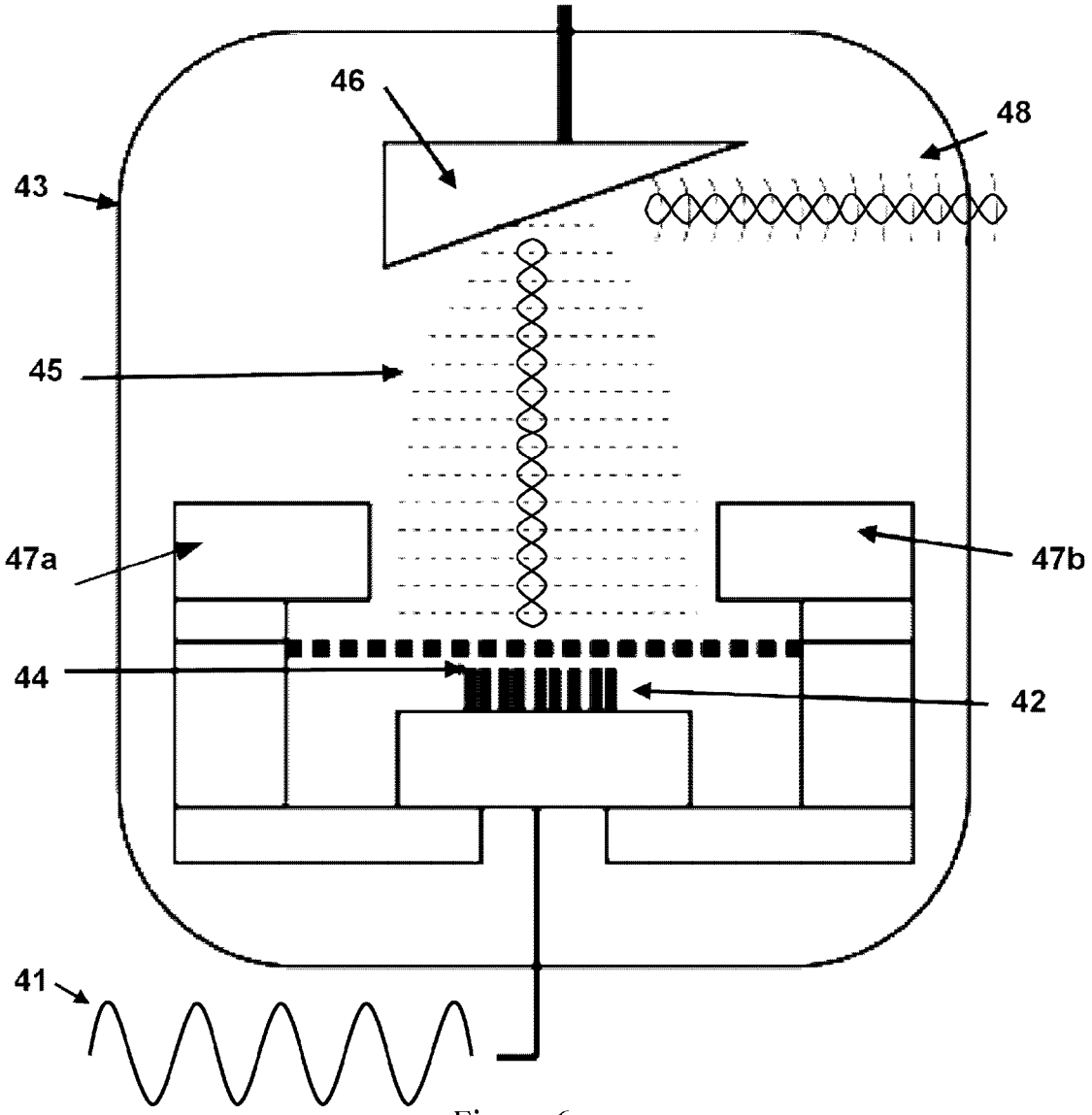
FIG. 6 is a schematic diagram showing a vacuum enclosure, and RF enclosure, focusing electrodes, grid electrode, field emission cathode and target anode housed within the vacuum enclosure, forming part of the device depicted in FIG. 3.

In FIG. 6, a biased and coupled RF signal 41 is applied to the cathode emitter 42 of an RF X-ray tube 43. In one or more embodiments, the field emission cathode 42 is formed from multiple carbon nanotubes on a metal, semiconductor or insulator substrate. The electron emission current density from the field emission cathode 44 toward the grid follows the amplitude of the biased and coupled RF signal. This results in a modulated electron density in space 45 that moves toward the high voltage anode 46 over time due to the high voltage anode electric field. This is illustrated as vertical envelope pattern showing electron density as function of distance (or time) with the horizontal lines corresponding to maximum electron density zones.

The presence of the voltage on the focusing electrodes 47*a* and 47*b* controls the lateral size of the electron beam when it hits the target face of the anode 46. As the size of the electron beam target spot on the anode 46 is small relative to the wavelength of the modulating RF signal, the X-ray emissions from the anode 46 appear as expanding hemispheres of photons with intensity proportional to the incident electron current at the time of photon generation. This results in a propagating X-ray emission through the X-ray window that has a modulating intensity 48 that is in phase with the modulating RF input signal 41 and hence the device performs as an RF to X-ray wavelet amplifier and transmitter. This is illustrated as horizontal envelope pattern showing X-ray photon density (or intensity) as function of distance (or time) with the vertical lines corresponding to maximum X-ray intensity zones.

The field emission device can be any suitable field emission device such as a carbon nanotube (CNT) field emission device, a diamond field emission device, and other nanostructured field emission devices. These may include carbon nanowires, tungsten nanowires, silicon pillars, silicon pyramids, nanostructured diamond, ceramics (e.g., metal or non-metal oxides such as alumina, silica, iron oxide, and copper oxide; metal or non-metal nitrides such as silicon nitride and titanium nitride; and metal or non-metal carbides such as silicon carbide; metal or non-metal borides such as titanium boride); metal or non-metal sulfides such as cadmium sulfide and zinc sulfide; metal silicides such as magnesium silicide, calcium silicide, and iron silicide; and semiconductor materials (e.g., diamond, germanium, selenium, arsenic, silicon, tellurium, gallium arsenide, gallium antimonide, gallium phosphide, aluminium antimonide, indium antimonide, indium tin oxide, zinc antimonide, indium phosphide, aluminium gallium arsenide, zinc telluride, and combinations thereof), tungsten nanowires, gold nanowires and other metallic nanowires.

Figure 7:
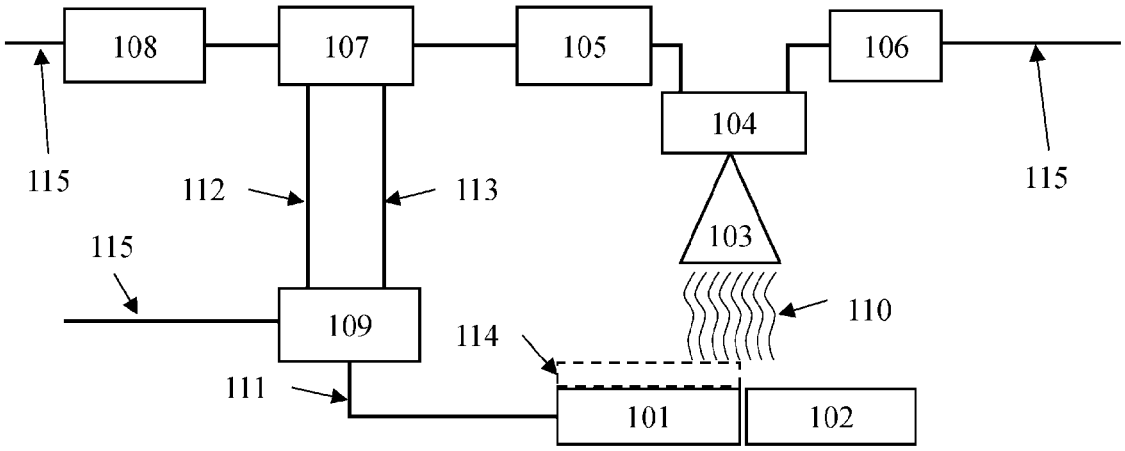
FIG. 7 is schematic diagram of a measurement system comprising an embodiment of a field emission based device as described herein for generating RF modulated X-ray radiation, a micro-channel plate (MCP) X-ray detector and an time-integrating (dosage) X-ray detector.
Figure 8:
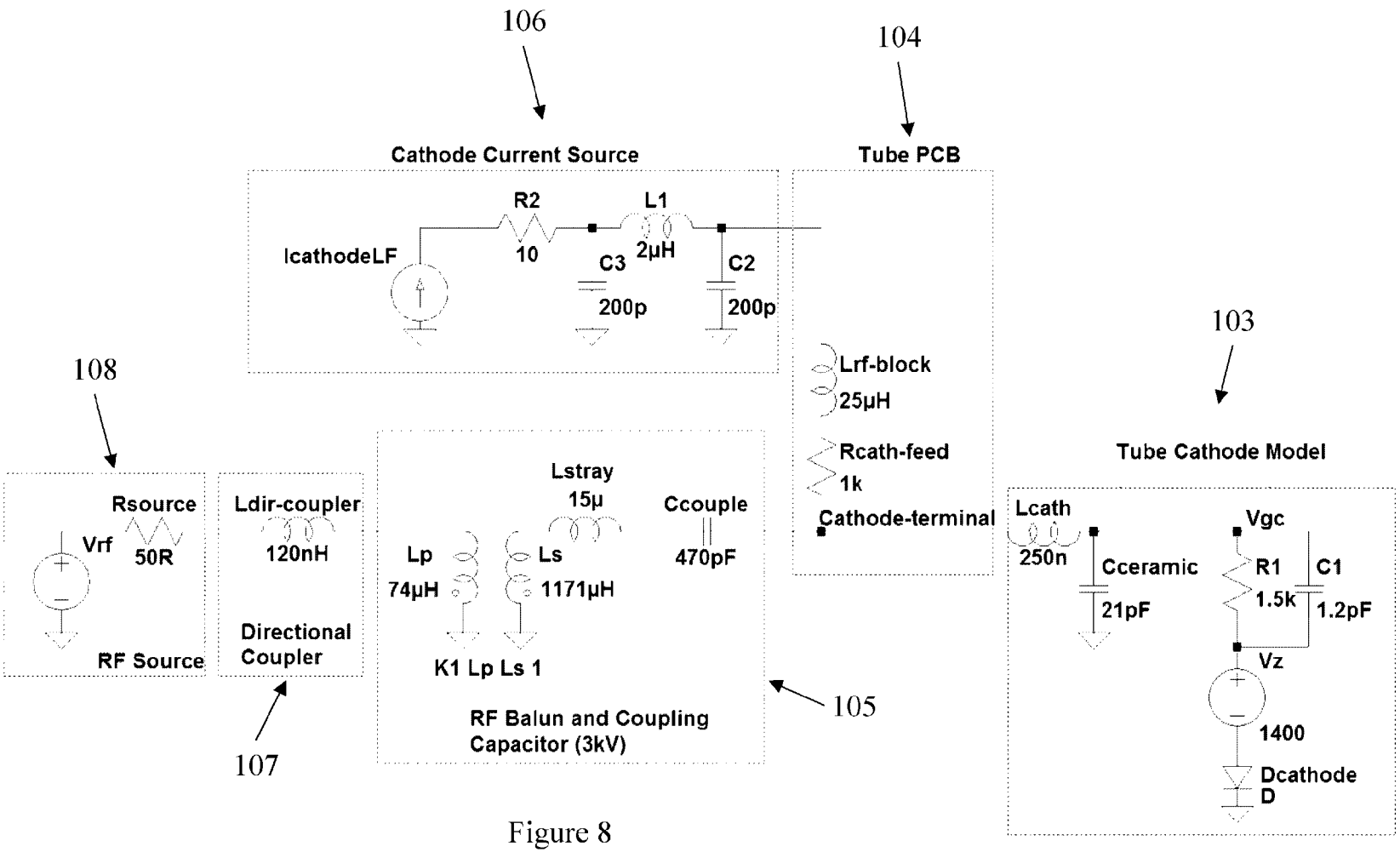
FIG. 8 is a circuit diagram of an RF impedance matching and coupling circuit used in one embodiment of the invention described herein, where the coupling circuit has been designed to cover a frequency window from 1 MHz to 30 MHz.

An embodiment of a system was constructed and the X-ray signal generated was measured using an X-ray detector sensitive to the real time variation in intensity and an integrating X-ray detector to confirm generation of X-ray dose. In this embodiment a CNT based X-ray tube 107 and corresponding generator from a Carestream DRX Revolution Nano was modified with an RF impedance matching and coupling circuit. FIG. 7 is schematic diagram of a measurement system comprising CNT X-ray tube 103, X-ray PCB board 104, RF impedance matching and coupling circuit 105, cathode current source 106, and an RF power source 108. A 4 channel oscilloscope 109 was configured to measure the forward RF signal 112 and the reflected RF signal 113 via bidirectional coupler 107 between the RF power source 108 and the RF impedance matching and coupling circuit 105. The oscilloscope 109 also measured the output (measured X-ray) signal 111 from a micro-channel plate (MCP) X-ray detector 101 which detected (received) the RF modulated X-ray signal from the X-ray tube. Additionally a time-integrating (dosage) X-ray detector (a Raysafe detector) 102 also measured the X-ray signal from X-ray tube 103. A pulse start trigger signal 15 was provided to the RF power source 108, oscilloscope 109 and cathode current source 106. The RF impedance matching and coupling circuit is shown in detail in FIG. 8. The coupling circuit is added outside of the vacuum enclosure and composed of discrete components. The coupling circuit allows RF power to be added in parallel to the X-ray tube current source from the Nano cart which acts as the bias voltage, labelled as current source in FIG. 8.

The RF coupling circuit block consists of a 1:4 bifilar wound RF transformer on 2× toroidal cores and a high voltage 470 pF ceramic disc capacitor. A 25 uH RF inductor is added in series to the 1 kOhm resistor on the Nano X-ray circuit board. The parasitic inductance of the loop formed by the transformer wiring, ceramic coupling capacitor, cathode feed-through and the ground return inductance from the grid mesh to the RF ground terminal is estimated to be between 250 nH and 500 nH. The RF coupling circuit covers a frequency window from 1 MHz to 30 MHz.

The X-ray signal is measured using a single Multichannel Plate Detector (MCP) 101. The MCP 101 directly measures the X-ray radiation and coverts the radiation into an electron current with a gain of approximately 104. The electron current is passed through a 50 Ohm resistor and the voltage signal proportional to the X-ray radiation intensity was measured with oscilloscope 109.

Figure 9A:
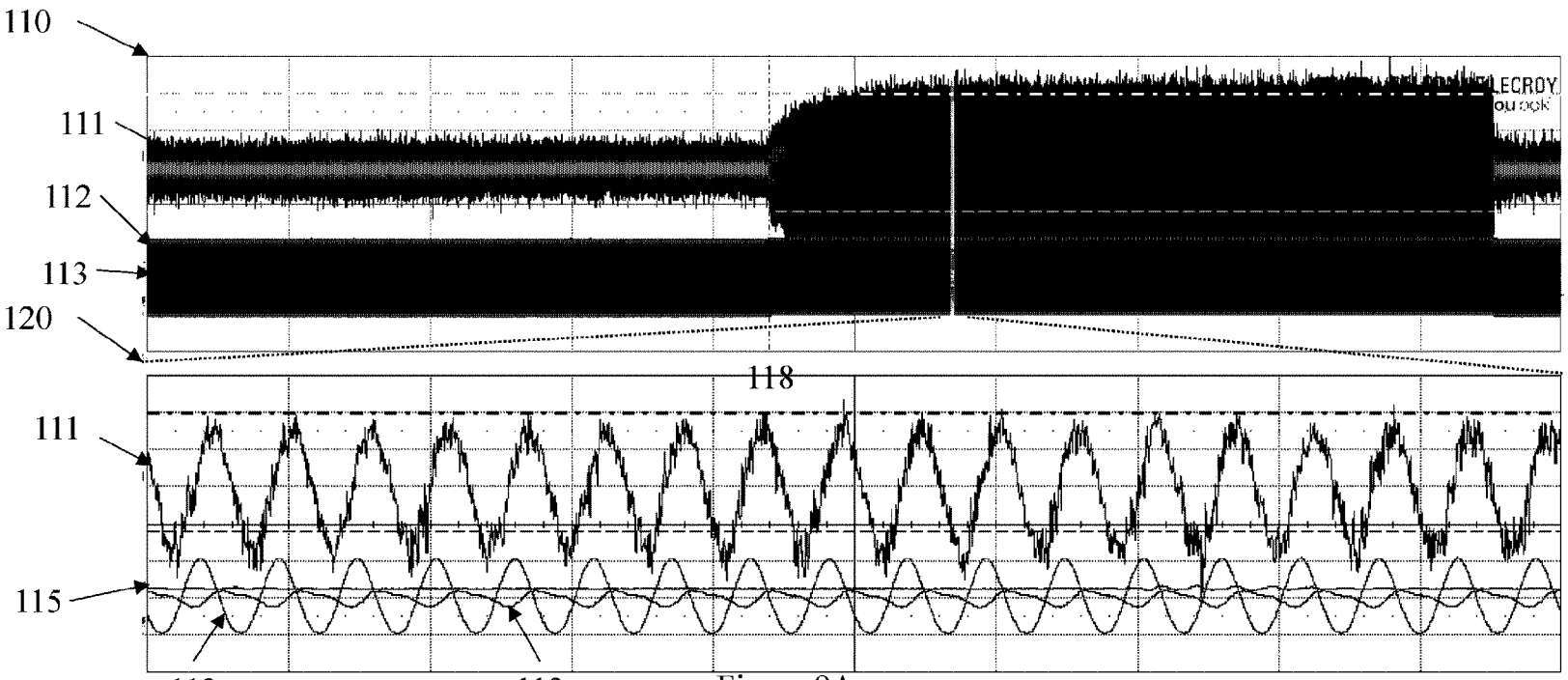
FIG. 9A is a measurement from a MCP X-ray detector from an embodiment of the measurement system shown in FIG. 7 of RF modulated X-ray radiation at 3.6 MHz from an embodiment of a field emission based device.

FIGS. 9A to 9D shows the results of testing using the system shown in FIG. 7. FIG. 9A shows the results of an RF modulated X-ray signal produced by the described embodiment. The top image shows a screen capture 110 from a four-channel oscilloscope 109 measurement of the MCP output voltage 111, the RF input power 112, and the RF reflected power 113. The RF signal 111 exists before the bias voltage is turned on (pulse start trigger signal 15), and once the bias voltage is turned on (at time point 118), the RF signal adds to the bias voltage and produces RF modulated X-ray radiation. Zoomed in portion 120 clearly shows a modulated signal 111 from the MCP detector at 3.6 MHz, and in phase with the input RF signal 112.

Figure 9B:
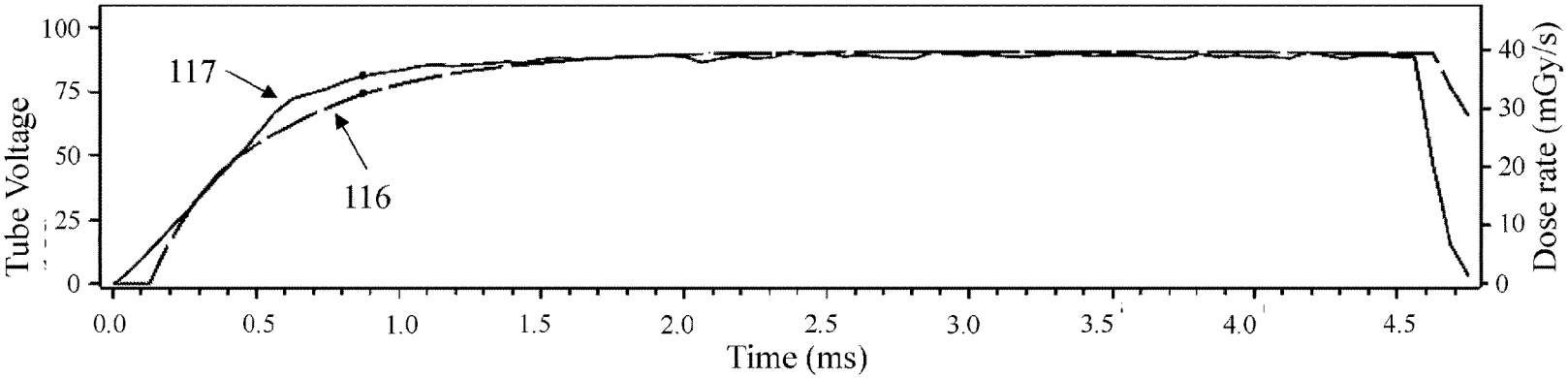
FIG. 9B is an independent X-ray dose measurement using a time integrating dose commercial dose measurement device from an embodiment of the measurement system shown in FIG. 7 of the time integrated RF modulated X-ray radiation shown in FIG. 9A.

FIG. 9B shows an independent measurement of X-ray radiation using a Raysafe dose detector. The Raysafe detector has a maximum response time of 1 ms and thus the RF signal is aliased and filtered out, however FIG. 9B clearly shows the tube voltage signal 116 and dose rate signal 117 at the same time as the MCP detector measured the RF modulated X-ray signal, independently confirming that X-rays were being generated by the X-ray tube.

Figure 9C:
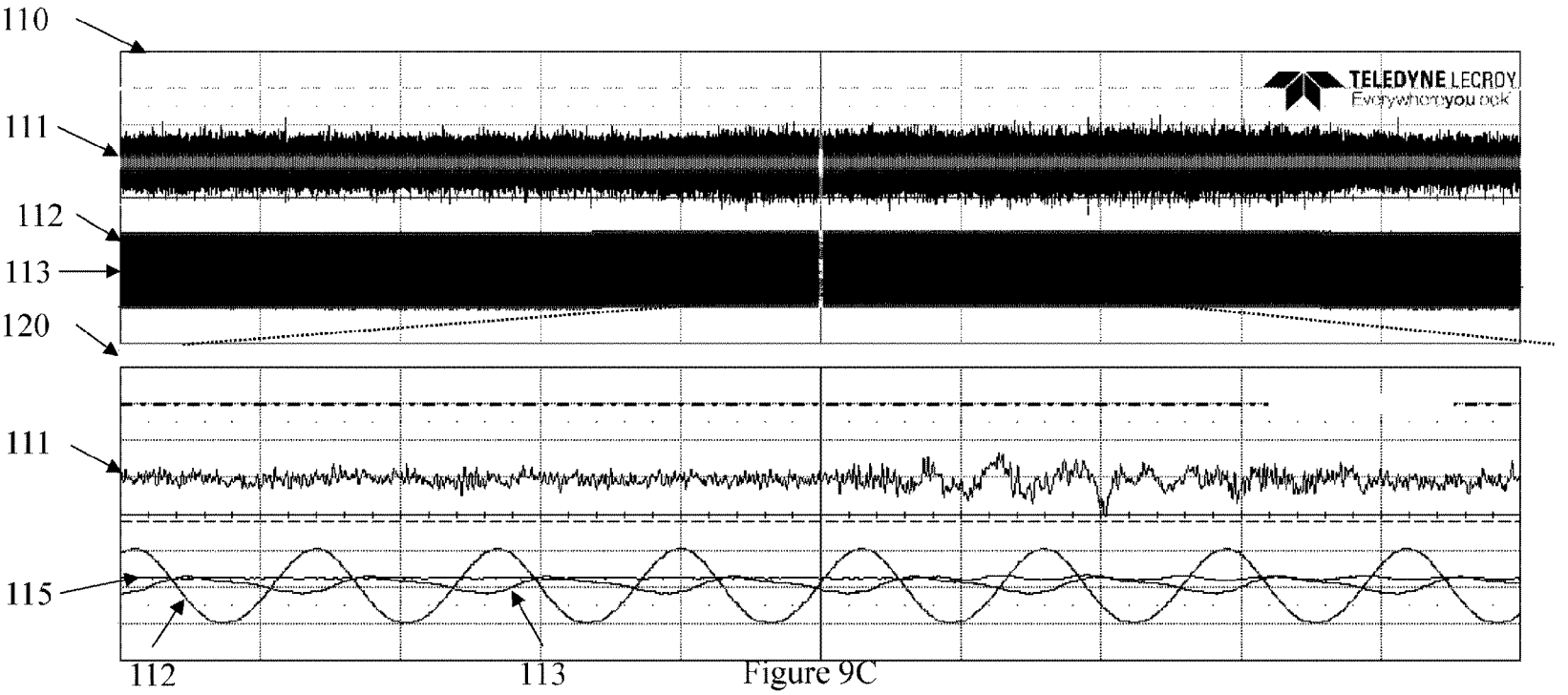
FIG. 9C is another measurement from a MCP X-ray detector from an embodiment of the measurement system shown in FIG. 7 of the RF modulated radiation in which the MCP X-ray detector was covered with a Lead plate to attenuate the X-ray signal to demonstrate that time varying signal shown in FIG. 9A is produced by the RF modulated X-ray radiation.
Figure 9D:
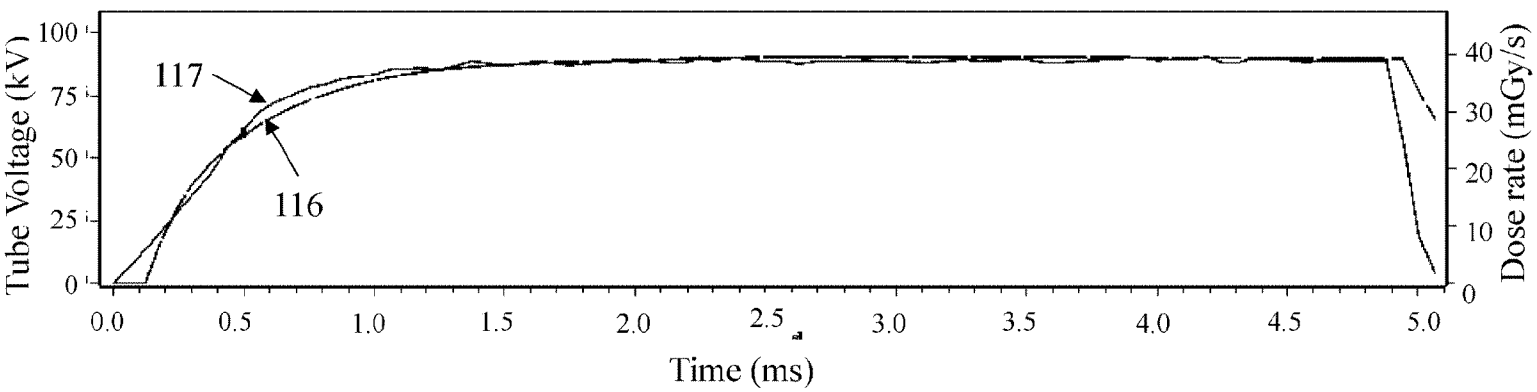
FIG. 9D is an independent X-ray dose measurement using a time integrating dose commercial dose measurement device from an embodiment of the measurement system shown in FIG. 7 of the time integrated RF modulated X-ray radiation shown in FIG. 9C to show that the device was generating X-ray radiation at the time of measurement of the signal shown in FIG. 9C.

This experiment was then repeated with Lead panel 114 placed over the MCP detector to block (attenuate) the X-ray signal. FIG. 9C shows a similar plot to FIG. 9A, but in this case the signal 111 from the MCP detector is essentially a noise signal with no voltage modulation (ie no RF modulated X-ray signal). The Raysafe dose measurement was not blocked by the lead panel and FIG. 9D shows the same X-ray dose as measured previously and shown in FIG. 9B. The difference between FIGS. 9A and 9C clearly demonstrates the RF modulated voltage signal is a measurement of RF modulated X-ray radiation produced by the described embodiment of the invention.

From the foregoing, it will be appreciated that embodiments of the invention relate to a device for generating radio frequency modulated electron flux, based around a radio frequency matching and coupling network connected to a field emission cathode within a vacuum enclosure. The electron flux, which hit a heavy metal anode, will vary with RF modulation resulting in a corresponding variation in generated X-ray intensity. The X-rays will be created across a board spectrum of wavelengths related to the target anode material and the energy applied to the target; the wavelengths of the X-rays being orders of magnitude smaller than the RF modulating frequency. Through careful design of the elements of the vacuum tube and the RF network, an RF X-ray amplifier can be constructed with an operating bandwidth well into the GHz operating range.

Due to the direct control of the electron emission at the cathode from the driving electric field, there is no requirement for the additional hardware electron bunching as used with existing solutions. Also, the amount of RF power required to drive the cathode is orders of magnitude lower than required for the solutions using the magnetic coupling techniques that use a Klystron for the RF power source. This substantially reduces the size, weight and power requirements of the device and supporting system hardware.

Another advantage that may ameliorate or provide an alternative to the above problems encountered when trying to produce a practical radio frequency modulated X-ray device is the high degree of linearity of the cathode current control that is provided by appropriately designed nanotechnology field emitters. This permits higher bandwidth and lower distortion devices to be created.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the disclosure is not restricted in its use to the particular application or applications described. Neither is the present disclosure restricted in its preferred embodiment with regard to the particular elements and/or features described or depicted herein. It will be appreciated that the disclosure is not limited to the embodiment or embodiments disclosed, but is capable of numerous rearrangements, modifications and substitutions without departing from the scope as set forth and defined by the following claims.

The invention claimed is:

1. A device for creating controlled radio frequency modulated X-ray radiation, the device including:

a vacuum enclosure;

an anode housed within the vacuum enclosure, which in use acts to accelerate and convert a radio frequency modulated electron beam into a radio frequency modulated X-ray radiation;

a radio frequency enclosure housed within the vacuum enclosure;

an extraction electrode in the radio frequency enclosure;

a field emission device comprising a field emission cathode housed within the radio frequency enclosure, wherein in use the field emission device is biased to emit the radio frequency modulated electron beam from the field emission cathode towards the anode due to a field emission cathode-extraction electrode field and the radio frequency enclosure decouples and shields the field emission cathode and the extraction electrode from the anode; and a radio frequency impedance matching and coupling circuit connected electrically to the field emission device and an external radio frequency signal source, and which is configured to apply a bias voltage and current to establish the field emission cathode-extraction electrode field for electron emissions, and to add a radio frequency modulation voltage so that an electron beam current is amplitude modulated by a radio frequency signal such that the field emission device produces the radio frequency modulated electron current beam.

2. The device as claimed in claim 1, wherein the field emission device comprises the field emission cathode, and the radio frequency impedance matching and coupling circuit is connected directly to the field emission cathode, and the extraction electrode is configured to allow the radio frequency modulated electron current beam to pass through the radio frequency enclosure.

3. The device as claimed in claim 1, wherein the field emission device comprises the field emission cathode and the extraction electrode, and the radio frequency impedance matching and coupling circuit is connected directly to the extraction electrode configured to allow the radio frequency modulated electron current beam to pass through the radio frequency enclosure.

4. The device as claimed in claim 1 wherein the field emission device comprises the field emission cathode and the extraction electrode and the bias is applied to the field emission cathode.

5. The device as claimed in claim 1 wherein the field emission device comprises the field emission cathode and the extraction electrode and the bias is applied to the extraction electrode.

6. The device as claimed in claim 1 wherein the extraction electrode is a grid extraction electrode.

7. The device as claimed in claim 1 wherein the extraction electrode is an aperture extraction electrode.

8. The device as claimed in claim 1 wherein the radio frequency signal source provides a radio frequency signal which is impedance matched to the field emission device by the radio frequency impedance matching and coupling circuit.

9. The device as claimed in claim 8 wherein the radio frequency impedance matching and coupling circuit is integrated into the field emission device and the field emission device has a 50 ohm input impedance.

10. The device as claimed in claim 9 wherein the radiofrequency impedance matching and coupling circuit is located external to the radiofrequency enclosure such that impedance matching is performed external to the radio frequency enclosure and the device further includes a radiofrequency vacuum feedthrough connection to connect the radio frequency impedance matching and coupling circuit to the field emission cathode electrode.

11. The device according to claim 1 further including focusing electrodes for controlling the focus of the radio frequency modulated electron beam.

12. The device according to claim 1 wherein the field emission cathode is formed from multiple carbon nanotubes on a metal, semiconductor or insulator substrate.

13. The device according to claim 1 wherein the radio frequency impedance matching and coupling circuit is integrated with the field emission device on a ceramic or silicon substrate.

14. The device according to claim 1 wherein the radio frequency impedance matching and coupling circuit is formed from discrete components on a printed circuit board that mounts to the outside of the vacuum enclosure.

15. The device according to claim 1 wherein the vacuum enclosure is a metal-ceramic vacuum chamber or a glass tube.

16. The device according to claim 1 wherein the vacuum enclosure includes an X-ray window to provide additional directivity to the radio frequency modulated X-ray radiation.

17. The device according to claim 1 further including an internal collimator housed within the vacuum enclosure to provide additional directivity of the radio frequency modulated X-ray radiation.

18. The device according to claim 1 further comprising the external radio frequency signal source, and a low frequency high-voltage bias circuit that supplies the bias voltage.

19. The device according to claim 1 wherein the X-ray tube polarity is a positive high potential anode and a ground referenced radio frequency enclosure.

20. The device according to claim 1 wherein the X-ray tube polarity is a negative high potential referenced radio frequency enclosure and a grounded anode, or a negative high potential referenced radio frequency enclosure and a positive high potential anode.

21. A method for creating radio frequency modulated X-ray radiation using a field emission cathode, the method comprising:

placing a field emission device comprising a field emission cathode within a radio frequency enclosure housed in a vacuum enclosure comprising a target anode;

providing a radio frequency signal directly to the field emission device to generate a radio frequency modulated electron current beam, where the field emission device is biased to emit the radio frequency modulated electron beam from the field emission cathode towards the anode due to a field emission cathode-extraction electrode field; and orientating or directing the radio frequency modulated electron current beam towards the target anode to produce radio frequency modulated X-ray radiation from the target anode.

22. The method as claimed in claim 21, wherein the field emission device comprises the field emission cathode and an extraction electrode and the radio frequency signal is provided directly to the field emission cathode, and the extraction electrode is configured to allow the radio frequency modulated electron current beam to pass through the radio frequency enclosure.

23. The method as claimed in claim 21, wherein the field emission device comprises the field emission cathode and an extraction electrode and the radio frequency signal is provided directly to the extraction electrode configured to allow the radio frequency modulated electron current beam to pass through the radio frequency enclosure.

24. The method as claimed in claim 21 wherein the field emission device comprises the field emission cathode and an extraction electrode and the bias is applied to the field emission cathode.

25. The method as claimed in claim 21 wherein the field emission device comprises the field emission cathode and an extraction electrode and the bias is applied to the extraction electrode.

26. The method as claimed in claim 21 wherein the radio frequency enclosure houses a grid extraction electrode.

27. The method as claimed in claim 21 wherein the radio frequency enclosure houses an aperture extraction electrode.

28. The method as claimed in claim 21 wherein the radio frequency signal is impedance matched to the field emission device.

29. The method as claimed in claim 28 wherein the impedance matching is integrated into the field emission device such that the field emission device has a 50 ohm input impedance.

30. The method as claimed in claim 29 wherein the impedance matching is performed external to the radio frequency enclosure and the radio frequency enclosure includes a radio frequency vacuum feedthrough connection.

* * * * *